US005348766A

United States Patent [19]

Latham

[11] Patent Number: 5,348,766

[45] Date of Patent: Sep. 20, 1994

[54] METHOD FOR MARBLEIZING AN OBJECT BY DIPPING THE OBJECT INTO PAINT FLOATING ON BORAX-CONDITIONED WATER

[76] Inventor: Elaine Latham, 308 Glyndon Dr., Reisterstown, Md. 21136-2139

[21] Appl. No.: 615

[22] Filed: Jan. 5, 1993

[51] Int. Cl.[5] ..... B05D 5/06

[52] U.S. Cl. ..... 427/202; 427/263; 427/274; 427/281

[58] Field of Search ..... 427/263, 268, 280, 281, 427/434.3, 274, 202; 118/402

[56] References Cited

U.S. PATENT DOCUMENTS

| | | | |
|---|---|---|---|
| 304,802 | 9/1884 | Dewar | 427/268 |
| 1,761,305 | 6/1930 | McGuire | 427/281 |
| 1,774,781 | 9/1930 | Witten | 427/267 |
| 1,931,667 | 10/1933 | Loetscher | 427/268 |
| 2,078,214 | 4/1937 | Esselen et al. | 427/280 |
| 2,087,504 | 7/1937 | Davis | 427/280 |
| 2,320,527 | 6/1943 | Licata | 106/311 |
| 2,373,211 | 4/1945 | Valdie | 427/281 |
| 3,202,527 | 8/1965 | Stevens | 427/263 |
| 4,091,126 | 5/1978 | Hidan | 427/434.3 |
| 4,231,829 | 11/1980 | Marui et al. | 427/434.3 |
| 4,490,413 | 12/1984 | Stimson | 427/262 |
| 4,983,716 | 1/1991 | Rao et al. | 524/186 |

FOREIGN PATENT DOCUMENTS

| | | | |
|---|---|---|---|
| 18214 | 2/1930 | Australia | 427/281 |
| 2246443 | 8/1974 | Fed. Rep. of Germany | 427/268 |
| 148187 | 10/1921 | United Kingdom | 427/281 |
| 245209 | 1/1926 | United Kingdom | 118/402 |
| 262601 | 8/1926 | United Kingdom | 427/281 |
| 276864 | 5/1927 | United Kingdom | 427/281 |

*Primary Examiner*—Terry J. Owens

[57] ABSTRACT

A method of using compositions and kits for preparing a flexible and permanent marbleizing coating on the surface of an object involves conditioning water with borax and testing the water, floating multiple color paints on the surface of the conditioned water, and dipping the object directly into this two phase liquid system. The color coating forms its own design on the water surface and does not need to be moved around. Small articles such as glitter, powders, beads, flakes, and fibers may be applied to the coated object before the paint dries or to the paint floating on the water. The coating may be transferred from the object to a second object by contacting these objects immediately after the dipping.

16 Claims, No Drawings

METHOD FOR MARBLEIZING AN OBJECT BY DIPPING THE OBJECT INTO PAINT FLOATING ON BORAX-CONDITIONED WATER

FIELD OF THE INVENTION

The present invention is directed to decorating articles and especially to methods for coating surfaces of articles with a multicolored pattern.

BACKGROUND TO THE INVENTION

Coating the surface of solid materials may be conventionally performed by dipping the solid material into a liquid coating composition. This technique has been enhanced by floating the coating material on another liquid. As the coating material floats on the surface of the other liquid, a layer may be formed which will then coat as a more uniform thin layer on the object being coated. This technique has been applied to both sheet material as well as three dimensional objects.

Bothwell, U.S. Pat. No. 846,774, is a very old example demonstrating the concept of floating a thick layer of paint on water and then dipping a sheet or other object in the liquid to apply a thin film of paint as a permanent coating on the articles being treated.

In more recent years, a number of variations on this method have been used with numerous devices for continuously coating objects. Several different additives to one or more reagents have been proposed. Leetacher, U.S. Pat. No. 1,931,667, discloses marbleizing the surfaces of objects by dipping the object into a water bath with a multiple oil color paint surface layer floating thereon. The colors in the oil paint may be applied in any design, preferably one with irregular patterns resembling marble. To keep the paints from flowing and to fix the design, Leetacher adds alum to a soapy water solution to form a scum which will bind the colors and fix them in a particular orientation. The color layers may then be cut in any shape and oriented as desired.

Various materials have been added to the floating paint surface to impart special visual effects. Other liquids have also been added to the floating paint layer to improve its uniformity and adhesion to the article being coated. For example, Bennett, U.S. Pat. No. 2,981,632, adds naphtha and other thinners to spread the floating oil colors on a water surface. Multiple paints or colors are used and materials may be added to impart different types of finishes.

Other surface effects have been provided to coating material. For example N,N-diethyl-meta-toluamide has been proposed to enhance the globule forming effect in Stimson, U.S. Pat. No. 4,490,413.

Dip coating methods have also employed soft water and a number of thinners such as turpentine, naphtha, etc. to form thin films of oil dyes on the surface of the water. One such example is Hidan, U.S. Pat. No. 4,091,126. The object resulting after coating has a marbleized surface on a solid article.

To thin paint, a large number of hydrophobic solvents have been proposed. An example is given in Bone, U.S. Pat. No. 1,343,387, using terpineol and kerosene. Other examples are given in Skinner, U.S. Pat. No. 3,245,821, using kerosene and naphtha among other materials, and Licata, U.S. Pat. No. 2,320,527, using turpentine, mineral spirits, naphtha and other non-polar organic solvents in paint to cause thinning of the paint.

While various dipping techniques have been employed in the past, none uses the paint formulations or the direct transfer technique of the present invention. Previous attempts with paints have found that paints do not spread on water in thin layers in a manner which allows them to almost disappear on the surface. Furthermore, the aforementioned techniques of the prior art have not been satisfactory for forming a thin paint surface on a coated object. Thus, a variety of attempts have been made to modify the conditions to use floating paint. Thick layers and a non-flowing layer of paint on a pasty support have been proposed. However, these techniques lack the flexibility and require artistic talent to paint a design on the surface before the object is contacted on the surface. Also movement of the design was not readily performed and the paint layer was much thicker.

Lead based paints have been used in the past. In recent years, the toxic effects of lead have become of greater concern. However, the physical properties differ and conditions are modified. Therefore, the use of lead-free paint would be a desirable product to use.

Therefore, a simple method for spreading a very thin mobile layer of paint on a water surface for coating of an object upon directly dipping an object has not been achieved with thin films of paints.

SUMMARY OF THE INVENTION

It is accordingly an object of the present invention to overcome deficiencies in the prior art, such as those mentioned above.

It is another object of the present invention to impart a marbleized surface coating on an object by floating plural colors of paint on water and then dipping an object directly into the water with floating paint to directly transfer the floating paint to the object.

It is a further object of the present invention to produce a marbleized design which is modifiable and readily controllable once paint has been placed on the surface of water.

It is yet a further object of the present invention to assay for water being properly conditioned so that paint readily spreads on the surface of water.

It is still another object of the present invention to prepare a kit for convenient use of lead-free paints to prepare a marbleized coating on an object.

It is yet another object of the present invention to mix appropriate paints and other thinners and solvents so that a paint will spread on a water surface.

It is still further an object of the present invention to spread paint on a surface of water without applying thickeners such as paste to the water.

It is further another object of the present invention to prepare a marbled design without the need for artistic talent or the hand painting of a marbled design.

The present invention thus relates to a direct transfer method for coating an object by dipping it into a container of water which has a thin layer of paint floating on the water surface. The water is preconditioned by adding borax so that the paint will spread over the water surface. Plural colored paints spread on the surface and actually form their own design if properly placed on the water surface. This design will transfer a mirror-like image to a clean dry surface of an object penetrating the film on the water surface. If the design is not satisfactory, the paint may be moved very slowly around the water surface as if drawing with a toothpick instead of a brush. When the paint starts to dry, it is time to stop and make the transfer. Paint compositions, kits and assay methods for appropriately conditioned water are also aspects of the invention.

DESCRIPTION OF THE PREFERRED EMBODIMENT

To begin the process, the water must first be conditioned with borax. Water impurities, chlorine, fluorine, pH and the amount of hardness differ with water sources. All water must be tested for conditioning before use. After filling a suitable container with room temperature water, about one tablespoon of 20 MULE TEAM BORAX TM is initially added to each three gallons of water. The solution is stirred until the borax is dissolved. The borax solution should be allowed to age for at least about 30 minutes to condition the water. A flat tray which is 2 inches deep is generally sufficient for marbleizing paper, clothing, boxes, tile or other thin objects that will be decorated on one side. For larger objects, a container at least about 4 inches deep is needed. Generally, the container depth should exceed the size of the object being coated or the portion of the object being coated. The container may have an inner liner which is removable for easy cleanup of paint floating to the edge of the water to coat the sides of the container. The inner liner may be made of waterproof tape or other easily removable and disposable material.

Alternatively, the solution may be prepared separately and then poured into a container suitable for dipping. If the borax is not dissolving adequately, the water may be heated to enhance dissolving and then the water is allowed to cool to room temperature before use.

The water solution containing an initial dose of borax is then ready to be tested for proper conditioning by placing a drop of paint on the water in the center of the container being used. If the water is sufficiently conditioned, the paint will float and spread on the water and seem to disappear.

Insufficient conditioning of the water will cause the paint to sink or fail to adequately spread. If this result occurs, additional borax is added and the process repeated until the paint adequately spreads on the surface of the water. Adequate spreading occurs when the paint color moves, opens up and seems to disappear. If too much borax has been added, the design eventually produced may break apart or become grainy.

The conditioned water may be used many times by skimming its surface with an absorbent material to adsorb and remove the remaining paint layer. Waste newspaper and the like are well suited for this function.

The objects to be marbleized (except for paper or fabric) are first cleaned. Using a rag with turpentine or mineral spirits is an acceptable means provided the surface is made free of dust. Porous surfaces, such as wood, are sealed with paint, shellac, acrylic spray or a sealer primer stain block. Metal objects also benefit from a coating on the surface. The object may be precoated with a semi-gloss enamel paint of any color. This pretreatment permits one to use less marbling paint. After cleaning, the objects are allowed to dry if not already dry to permit the paint to stick to the objects.

The color of the object can become the background color in the final product. If the natural surface is desired as a background, the object may be coated with a clear shellac or similar clear material. The choice of objects to be coated is almost limitless provided that they are clean, dry and sufficiently non-porous. Glass, wood, metal, fabric, paper, plastic, wax and rubber are among the numerous solid objects which may be marbleized. Almost anything that can be put into water without dissolving or reacting can be marbleized. The shape of the object being coated is not critical provided that the container is wider and deeper than the object.

In order to make a design, one must use a minimum of two colors. When properly placed and enough opposite colors are used, a design will form. The paint is fluid and may also be moved around to form another design, if desired. The first drop of paint applied to the water surface will form the background color provided that it covers most of the water surface. Drops of paint may be added by free falling drops close to the water surface or by touching a paint coated applicator to the surface of the water. When the first drop of paint is added to the center of the water surface, the paint will spread so thin that the drop appears to disappear leaving a film on the water.

Additional drops of one or more different colors of paint must also be added inside the outer edge of the first color and will push the first color of paint away each color fighting for space. The second and/or later colors added within the outer edge of the first color produce a marbleized effect. If too much borax has been added, the design eventually produced may break apart or become grainy. As more colors of paint are placed on the water, the design will keep building and changing. When a pleasing design is formed, wait until the paint stops moving and it is time to dip an object.

The amount of paint added to the surface depends on the size of the container and the object being dipped in the water. The paints do not mix but rather one color pushes the other color(s) across the water surface. The paint will float on the surface of the water and will not mix together. The paints are lead-free, oil based and insoluble in water. By adding the appropriate amount of thinners or diluents and paint conditioners, the paint will readily spread over the water surface. The diluents or thinners should be added to the paints and never to the water.

The process may be repeated by dropping paint into areas of a different color while the paint is still active. Each time a drop of paint is added, the added paint will push the existing color aside. The placement of the drops of paint is not critical for functionality but is important to forming the desired design. The total amount of paint will vary with the amount of surface area to be covered. As an example, about 15–30 drops of paint are needed to cover the surface of water in a typical three to five gallon bucket having a diameter of about one foot, i.e. having a surface area of about 100 to about 150 square inches. While the exact thickness of the floating paint film has not been measured, it is very thin, much thinner than that used previously by some other coating techniques.

Enough paint must be added to form a design. The placement of the drops is important for the proper formation of a design. The first paint is placed in the center of the container. Subsequent drops are generally placed within the edges of the first color and will open up to form a design.

There are two ways designs are formed. When properly placed on the water and enough paint is used, they create their own design. If the design is not satisfactory, it can be changed by carefully drawing a toothpick or similar object through the paints moving it gently and the design keeps taking new shape. This must be done before the paint starts to dry.

If so desired the pattern may be altered after it has been initially formed. Shapes may be moved around on the surface of the water using one or more toothpicks or similar objects and the design can be completely changed. Any design pleasing to the user may be made and then directly transferred to an object.

Depending on the weather conditions, a variable amount of time will be allowed to pass to partially dry the paint on the water surface. Under hot dry conditions the paint may dry in a matter of minutes. Under cooler humid conditions, the paint may need to set several minutes before dipping. Once the paint has started to dry, it will adhere to almost any surface. Partial drying causes the paint to become less fluid which alters the way of making a design. The water helps to set the paint as soon as it transfers from the water to the object.

When an object has been dipped, before it is pulled from the water, a clean area is made on the water surface by blowing on the surface of the water to push away the paints as the object will pick up paint on the way up and ruin the design.

In the case of a large object in a large container, other objects may be dipped to use up the paints as long as the first object is held beneath the water. Before bringing the object out, the excess paint should be skimmed off with newspaper so the design will not be ruined.

If the paint runs when the object is removed, the paint needs to partially dry longer before dipping an object, the object is not dry or there is too much borax for the water conditioning. Generally, there is a five to ten minute time period when the paint is adequate for decorating objects by direct transfer.

The same colors may be applied sequentially to multiple objects by sequentially dipping each of these objects into the water. Each time, the pattern will appear lighter and will change on an object being coated. When one wishes to use a different color pattern, paint may be removed from the surface with waste newspaper or the like to adsorb the paint and a new design produced. As noted above, the water may be reused.

The present invention is the first to effectively coat an object by direct transfer. The object is directly lowered from above the surface so that it first contacts the floating paint and then is set by the water carrier below. The paint or water does not need to be swirled or painted on the surface. Significant to this direct transfer technique is that the colors of paint adhere to the object and do not run or peal off.

When the sheet or object is dipped or rolled into the solution, the bath transfers the paint from the water surface to the surface of the sheet or object. If the sheet or object does not have sufficient rigidity for easy handling, the sheet or object may be attached to or filled with other material to impart sufficient rigidity to the object such as a clothing form of plastic or cardboard.

An object that is to be partially decorated can be masked off, with masking tape which can be removed after the transfer is made. Such a technique can be used with solid objects such as the soles of shoes or sneakers. Clothing can be decorated with other fabric that has been dipped and allowed to dry and wither sewn or pressed on with a special press on product. To decorate a small area of a T-shirt, the selected portion of the shirt can be placed in an embroidery hoop and masking tape is put around the edge of the hoop to protect the rest of the material from the paint. The design is transferred by placing flat on the water instead of dipping.

If the particular design is not to the liking of the user, the object may be allowed to dry and another color combination and design may be transferred over the first attempt. The combination may create a very interesting layered effect. Before the paint is dry, it may be removed with any conventional paint solvent and then another coating applied except on fabric, paper and other material which has absorbed the paint.

If so desired, either the paint or the freshly painted object may attach one or more small articles to the object by contacting the wet paint. Such small articles would then become part of the coating and impart a decorative effect. Examples of small articles include glitter, powders, beads, flakes and fibers. The object should be allowed to air dry. It is also possible to transfer the coating from the first object to a second object by contacting these objects together immediately after removal of the first from the bath. A test kit may be formed by including one or more containers of paint. Each container preferably contains only one color paint. The test kit may also include borax, written and/or audio and/or video tape instructions, applicators for moving paint on the water surface and/or objects to be coated.

The paints used in the kit, including thinners or diluents were prepared according to the formulas given in the chart below.

Formulas
Units are Fluid Ounces

| Color | Paint Base | Petroleum Distillates | Aliphatic Petroleum Distillates | Clay Treated Distillate |
|---|---|---|---|---|
| White | 128 | 20 | 24 | |
| Black | 128 | | 28 | |
| Light Yellow | 128 | 20 | 24 | |
| Purple | 128 | 40 | | 12 |
| Teal | 128 | 40 | | 12 |
| Rose | 128 | 40 | | 12 |
| Light Blue | 128 | 40 | | 12 |
| Peach | 128 | 20 | 24 | |
| Brown | 128 | 20 | 24 | |
| Red | 128 | 40 | 40 | |
| Green | 128 | 20 | 24 | |
| Bright Yellow | 128 | 20 | 18 | |
| Dark Blue | 138 | 10 | 12 | |
| Blue-Gray | 128 | 20 | 24 | |
| Soft Purple | 128 | 40 | | 12 |
| Dark Purple | 128 | 40 | | 12 |

The amounts of each ingredient is important to the proper functioning of the paint. Variations of as little as a few percent can adversely effect the ability of the paint to spread and flow, its smoothness, the drying time and how well it sticks to the article being dipped.

The components vary slightly from batch to batch and with different manufacturer. Each batch must be individually tested for spreading on the conditioned water surface, preferably against another paint composition which does spread. Variations on the above compositions may be needed and should be employed when the paint does not spread on conditioned water.

A turpentine containing composition may optionally be used in addition or as a partial or complete replacement for the Petroleum Distillates and the Aliphatic Petroleum Distillates.

The composition of the ingredients of each component are as follows:

The Aliphatic Petroleum Distillates contains: aliphatic petroleum distillate—95–100% CAS#64742-89-8 which consists of 95–100% VM&P Naphtha CAS#8032-32-4, flash point 50° F., 100% volatile, BP 116.66° C., 242°–300° F., Density 6.250 lbs/gal at 75° F., vapor pressure 13 mm Hg at 20° C.

Petroleum Distillates contains: 63% petroleum distillates <6% CAS#8008-20-6 and >57% CAS#864742-88-7, flash point 125° F., 70% volatile, Boiling range 300°–500° F., Density 7.1 lbs/gal at 75° F., vapor pressure 1.0 mm Hg at 70° F.

Clay Treated Distillate contains: CAS#64742-38-7, flash point 115° F., Boiling point 330°–572° F., Specific Gravity 0.81, Vapor Pressure 2 mm Hg at 68° F. and % volatile—nil.

Base Paint: Lead-free, high gloss enamel high hiding white alkyd paint, 45% Mineral Spirits CAS#64742-88-7, 25% Titanium Dioxide CAS #13463-67-7, Flash point 116° F., boiling point 302°–390° F., density 9.4 lbs/gal., 56% volatile, 8.3 lbs/gal. solids. Pigments vary based on the color.

The foregoing description of the specific embodiments reveal the general nature of the invention so that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

All references mentioned in this application are incorporated by reference.

What is claimed is:

1. A method for coating a surface of an object with a design, comprising, floating a first oil-based paint containing at least one diluent on a surface of water which has been conditioned with borax sufficiently that a first drop of the paint placed on the water surface spreads in a layer over the surface sufficiently thin that the drop appears to disappear, floating at least one additional oil-based paint of a color different from said first oil-based paint on the surface of said borax-conditioned water, dipping an object into the water so that the surface of the object contacts the floating paint on the water surface, and removing the object from the water and drying the object to form a coated object which maintains the design.

2. The method according to claim 1 further comprising sealing the surface of the object before it is dipped into the water.

3. The method according to claim 1 wherein the oil-based paints are lead-free.

4. The method according to claim 1 wherein the oil-based paints are applied sequentially to the water surface.

5. The method according to claim 4 wherein after said paints are applied, the paints are moved over the water surface to form a pattern.

6. The method according to claim 1 wherein said object is a sheet.

7. The method according to claim 1 further comprising contacting the coated object to a second object before the paint dries thereby transferring said coating to said second object.

8. The method according to claim 1 further comprising adding an article, smaller than said object, to said coated object before the paint dries or to the paint floated on the water, wherein said article adheres to said coating.

9. The method according to claim 8 wherein said article is substantially much smaller than the object being coated and is selected from the group consisting of glitter, powder, beads, flakes and fibers.

10. A method for coating a surface of an object with a design, comprising conditioning a quantity of water by adding borax thereto to form a borax solution, and permitting said borax solution to age for a minimum time of about thirty minutes, providing said borax solution in a container so as to define an upper surface of said borax solution, floating a first colored thinned paint on the surface of said borax solution so that a first drop of the thinned paint spreads in a layer with an outer peripheral edge over said surface sufficiently thin so that said first drop appears to disappear, floating at least one differently colored thinned paint on said upper surface of said borax solution within said outer peripheral edge of said first color to form at least a second color over said upper surface, dipping an object into said borax solution through said paints so that the surface of the object contacts the floating paints on the borax solution surface, and removing the object from the borax solution and drying the object.

11. A method according to claim 10 wherein said object is substantially non-porous.

12. A method according to claim 10 comprising permitting said floating paint on said borax solution surface to partially dry before dipping said object.

13. A method according to claim 10 comprising creating a clean area on said borax solution upper surface after dipping said object and before removal of said object therefrom.

14. A method according to claim 10 wherein said thinned paint comprises an oil-based paint thinned with a water-insoluble petroleum distillate diluent.

15. A method for coating a surface of an object with a design, comprising conditioning water with borax so that paint will spread on a surface of said water and be acceptable for transferring to an article dipped into the water, adding a drop of paint to the surface of the so-conditioned water, determining whether the paint spreads on the water surface, adding additional borax to the water if needed until a drop of paint spreads on the water surface in a layer sufficiently thin so that said drop of paint appears to disappear, then floating a plurality of different colored paints on the surface of the conditioned water so that the paint spreads over the surface, dipping an object into the water so that the surface of the object contacts the layer of floating paint on the water surface, and removing the object from the water and drying the object.

16. The method according to claim 15 wherein the paints are oil-based paints thinned with a diluent.

* * * * *